US010440468B1

(12) United States Patent
Kelley

(10) Patent No.: US 10,440,468 B1
(45) Date of Patent: Oct. 8, 2019

(54) SYSTEMS AND METHODS FOR PROVIDING AUGMENTED REALITY AUDIO

(71) Applicant: United Services Automobile Association (USAA), San Antonio, TX (US)

(72) Inventor: Patrick Raymond Kelley, San Antonio, TX (US)

(73) Assignee: United Services Automobile Association, San Antonio, TX (US)

( * ) Notice: Subject to any disclaimer, the term of this patent is extended or adjusted under 35 U.S.C. 154(b) by 0 days.

(21) Appl. No.: 16/175,139

(22) Filed: Oct. 30, 2018

Related U.S. Application Data

(60) Provisional application No. 62/578,980, filed on Oct. 30, 2017.

(51) Int. Cl.

| | |
|---|---|
| ***H04R 5/02*** | (2006.01) |
| ***H04R 1/40*** | (2006.01) |
| ***H04R 17/00*** | (2006.01) |
| ***H04R 1/10*** | (2006.01) |

(52) U.S. Cl.
CPC ..... *H04R 1/403* (2013.01); *H04R 1/1075* (2013.01); *H04R 17/005* (2013.01); *H04R 2201/40* (2013.01)

(58) Field of Classification Search
CPC ..... H04R 5/02
See application file for complete search history.

(56) References Cited

U.S. PATENT DOCUMENTS

| | | | | |
|---|---|---|---|---|
| 9,100,732 | B1 * | 8/2015 | Dong | H04R 3/00 |
| 2017/0195795 | A1 * | 7/2017 | Mei | H04R 5/0335 |
| 2018/0139565 | A1 * | 5/2018 | Norris | H04S 7/304 |
| 2018/0192227 | A1 * | 7/2018 | Woelfl | H04R 5/033 |
| 2019/0052954 | A1 * | 2/2019 | Rusconi Clerici Beltrami | G10K 11/175 |
| 2019/0060741 | A1 * | 2/2019 | Contreras | A63F 13/212 |

* cited by examiner

*Primary Examiner* — Olisa Anwah
(74) *Attorney, Agent, or Firm* — Fletcher Yoder, P.C.

(57) ABSTRACT

A method may include receiving, via a processor, location information regarding an object. The method may also include generating, via the processor, audio data based on the location information, and sending, via the processor, the audio data to at least one of a plurality of speakers. The audio data may convey directional information related to a relative location of the location information with respect to the processor, and the plurality of speakers may output one or sound waves based on the audio data.

20 Claims, 3 Drawing Sheets

SYSTEMS AND METHODS FOR PROVIDING AUGMENTED REALITY AUDIO

CROSS-REFERENCE TO RELATED APPLICATION

This application claims priority to and the benefit of U.S. Provisional Application No. 62/578,980 entitled "SYSTEMS AND METHODS FOR PROVIDING AUGMENTED REALITY AUDIO," filed Oct. 30, 2017, which is hereby incorporated by reference in its entirety for all purposes.

BACKGROUND

The present disclosure relates generally to systems and methods for outputting audio sounds in an augmented reality environment. More specifically, the present disclosure relates to a hardware device that outputs audio, such that a user is still able to listen to sounds provided in a surrounding area.

As visual augmented or mixed reality headsets are used in various industries, it is more apparent that providing an augmented or mixed audio to supplement the augmented visualization displayed via the headsets may be useful. That is, the mixed or augmented reality headsets may generally allow a user to view real objects in addition to virtual objects. In order to provide the same ability to listen to real sound surrounding a user, while providing augmented sound, improvements in the audio devices used with these headsets are desirable.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system may include a number of speakers that may output audio data. The system may also include a processor that may receive location information regarding an object, generate the audio data based on the location information, and output the audio data via at least one of the speakers. The output audio data may convey directional information that corresponds to a relative position of the object with respect to the system.

In another embodiment, an audio speaker system may include a plurality of speakers that may output one or more sound waves, such that each speaker of the plurality of speakers may include a filter composed of a metamaterial. The audio speaker system may also include a channel that may connect each speaker of the plurality of speakers to each other, such that the channel may be disposed on an ear of a user.

In yet another embodiment, a method may include receiving, via a processor, location information regarding an object. The method may also include generating, via the processor, audio data based on the location information, and sending, via the processor, the audio data to at least one of a plurality of speakers. The audio data may convey directional information related to a relative position of the location information with respect to the processor. The plurality of speakers may output one or more sound waves based on the audio data.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
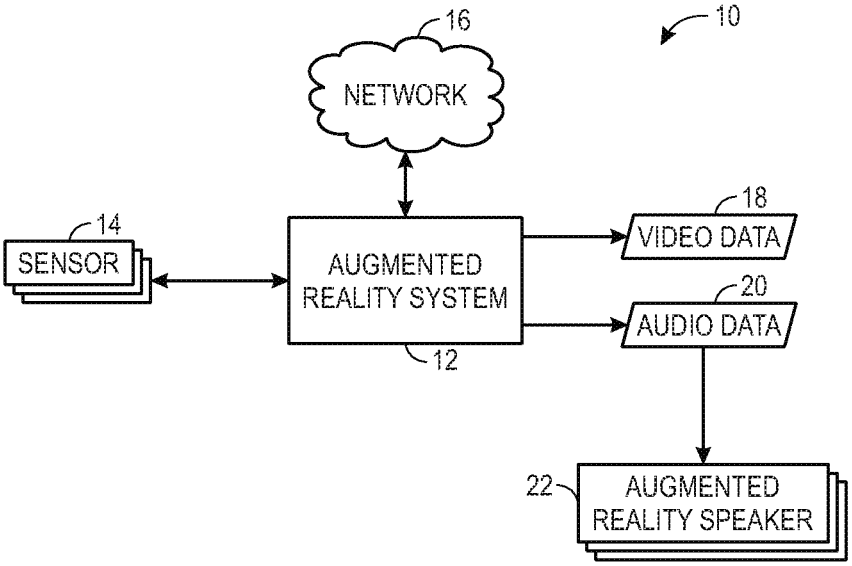
FIG. 1 illustrates a block diagram of a system in which an augmented reality system is communicatively coupled to a number of components, in accordance with embodiments described herein.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Audio headsets or headphones generally mute or filter the sounds of the surrounding environment when in use. That is, when a user wears an audio headset, the audio headset is designed to direct the produced sound to the ears of the individual while the earpieces of the headset are designed to filter or mute the surrounding or ambient noise from being received by the ear drums of the user. It is now recognized that it may be useful to provide audio outputs for a user, such that the user may still be aware of his surrounding audible environment. In this way, audio may be used in an augmented reality system to provide audible information to a user without inhibiting the user's ability to hear sounds produced from his surrounding environment.

With the foregoing in mind, in certain embodiments of the present disclosure, an augmented reality headset may include at least three speakers that are positioned along the headset adjacent to at least three different locations surrounding the user's ear canal. The three speakers disposed around the user's ear may be used to provide three-dimensional sounds that convey directional information or other audible information that the user may hear while maintaining his ability to hear sounds from his surrounding environment. As such, while the user is listening to sounds produced in his surrounding environment, augmented audio may be provided to him via the augmented reality headset to convey additional information to the user. For example, the additional information may provide a sound that conveys directional information or is perceived by the user as originating from a particular direction to provide the user with information related to an object in the presence of the user. By providing the directional sound cues while the user maintains his ability to hear his surrounding environment, the augmented reality system may enable the user to perform multiple tasks more efficiently, simultaneously receive audible information from an external source while receiving audible information from his surrounding environment, and the like. Additional details with regard to employing the augmented reality headset in different situations will be discussed below with reference to FIGS. 1-6.

By way of introduction, FIG. 1 is a block diagram of an augmented reality network 10 that illustrates an augmented reality system 12 communicatively coupled to one or more sensors 14 and a network 16. The augmented reality system 12 may include any suitable computer device, such as a general-purpose personal computer, a laptop computer, a tablet computer, a mobile computer, and the like that is configured in accordance with present embodiments. The augmented reality system 12 may receive data from the sensors 14 or the network 16. The received data may provide an indication or instruction for the augmented reality system 12 to generate augmented video data 18 for an electronic display and augmented audio data 20 for audio output. The augmented video data 18 may include visualizations or images that may be superimposed over objects or an environment visible to a user of the augmented reality system 12. By way of example, the augmented reality system 12 may display images on a transparent electronic display, such that a user of the augmented reality system 12 to view real objects though the transparent display (e.g., clear) along with virtual image data (e.g., augmented video data 18). As used herein, the user may refer to an individual wearing or using the augmented reality system 12.

The augmented audio data 20 may include audio data that may be designed to provide audio output that may be discernable while in the presence of audible noise surrounding the user of the augmented reality system 12. That is, the user may wear an audio headset that may allow ambient noise surrounding the user to be discernable by the user's ears while also providing additional audio output that may also be discernable by the user's ears in the presence of the ambient noise. As such, in certain embodiments, the audio data 20 may be output as audio by multiple augmented reality speakers 22. The augmented reality speakers 22 may include more than one audio speaker that may be placed on an audio headset, such that each audio speaker may output a sound that may convey information that may be interpretable to the user along with the ambient noise.

In some embodiments, the augmented reality speakers 22 may be disposed at different locations surrounding the user's ear to produce directional information. Directional information may convey location information concerning an object or item in the presence of the user. For example, the directional information may include a sound that appears to be originating from a particular location. In some embodiments, the sound may increase in volume, frequency, or the like as the user moves close to the particular location. In addition, the augmented reality speakers 22 may serve as an intercom system to provide the user with additional information regarding various objects that may be located within a proximity of the user while enabling the user to still hear the sounds in his surroundings.

By way of example, the augmented reality system 12 may receive the augmented audio data 20, which may include information related to an estimated cost for repairing a vehicle. The augmented reality system 12 may receive the augmented audio data 20 while the user is interviewing an individual who may be providing information related to the vehicle. For example, the augmented audio data 20 may cause the augmented reality system 12 to output audio (e.g., sound waves) via the augmented reality speakers 22 to provide verbal instructions or indications related to the information regarding the vehicle.

In addition, the augmented audio data 20 may be synchronized with the augmented video data 18 to simulate an audible sound generated by an object simulated by the augmented video data 18. For instance, if the augmented video data 18 generates a beacon light in a certain corner of the electronic display, the augmented audio data 20 may simulate an audio sound output via the augmented reality speakers 22 that appears to originate from a location that corresponds to the beacon light. The simulated sound may be generated by using just one of the multiple augmented reality speakers 22 or using a combination of the sounds output by the multiple augmented reality speakers 22 to cause the user to interpret the combined sounds as originating from a particular location. Additional details with regard to the augmented reality speakers 22 will be discussed below with reference to FIGS. 3 and 4.

As mentioned above, the augmented reality system 12 may output augmented audio data 20 that provides additional information concerning the surrounding environment. For example, the additional information may include details related to a value of a property, the locations of various objects (e.g., fire hydrant) with respect to a location of a home, and the like. In some embodiments, the augmented reality system 12 may receive the additional information or the augmented audio data 20 via the network 16. The network 16 may include any suitable network that includes a collection of computing systems communicatively coupled together via a wireless or wired communication link. As such, the network 16 may include an intranet, the Internet, or the like. In some embodiments, the augmented reality system 12 may provide information (e.g., location) regarding its surrounding and may receive additional data regarding the surrounding area from a remote computing device via the network 16.

In addition to receiving data via the network 16, the sensors 14 may provide data to the augmented reality system 12 to cause the augmented reality system 12 to generate augmented audio data 20 for output via the augmented reality speakers 22. For example, the sensors 14 may enable the augmented reality system 12 to determine a relative location of the sensors 14 with respect to the augmented reality system 12. The relative location information may then be employed by the augmented reality system 12 to produce a sound or audio to convey to the user a relative direction of the sensor 14 with respect to the user. In some cases, as the augmented reality system 12 moves closer to the sensor 14, the volume of the audio may increase in amplitude to convey that the augmented reality system 12 is moving close to the sensor 14.

The sensors 14 may include any suitable sensor that may measure a property associated with some object. In one example, the sensors 14 may include a radio-frequency identification (RFID) tag that includes information regarding an object that is associated with the RFID tag. In addition, the RFID tag may be used to discern a location of the associated object, such that the augmented reality system 12 may generate augmented audio data 20 that provides directional information related to a relative location of the object with reference to the location of the augmented reality system 12. The sensors 14 may also include a smart home device such as a network-connected television, a network-connected thermostat, a network-connected appliance, and the like. In any case, the sensors 14 may provide data to the augmented reality system 12 to enable the augmented reality system 12 to determine a location of a respective device and provide the augmented audio data 20 to convey additional information regarding the respective object, such as a type of object, a manufacturer of the object, and other information related to the object.

Figure 2:
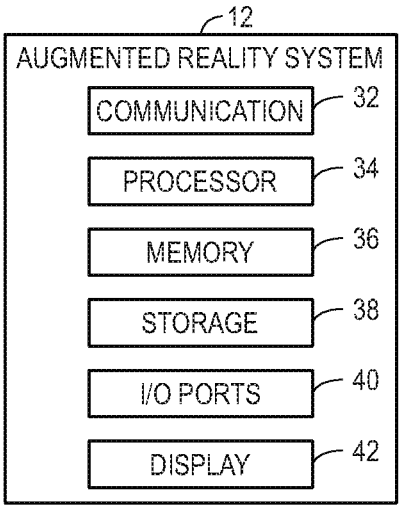
FIG. 2 illustrates a block diagram of the augmented reality system in the system of FIG. 1, in accordance with embodiments described herein.

One or more of the computing systems coupled to the network 16 and the augmented reality system 12 may include various types of components that may assist the respective systems in performing various types of computer tasks and operations. For example, as illustrated in FIG. 2, the augmented reality system 12 may include a communication component 32, a processor 34, a memory 36, a storage 38, input/output (I/O) ports 40, a display 42, and the like. The communication component 32 may be a wireless or wired communication component that may facilitate communication between the augmented reality system 12 and various other computing systems via the network 16, the Internet, or the like.

The processor 34 may be any type of computer processor or microprocessor capable of executing computer-executable code. The processor 34 may also include multiple processors that may perform the operations described below.

The memory 36 and the storage 38 may be any suitable articles of manufacture that can serve as media to store processor-executable code, data, or the like. These articles of manufacture may represent computer-readable media (e.g., any suitable form of memory or storage) that may store the processor-executable code used by the processor 34 to perform the presently disclosed techniques. As used herein, applications may include any suitable computer software or program that may be installed onto the augmented reality system 12 and executed by the processor 34. The memory 36 and the storage 38 may represent non-transitory computer-readable media (e.g., any suitable form of memory or storage) that may store the processor-executable code used by the processor 34 to perform various techniques described herein. It should be noted that non-transitory merely indicates that the media is tangible and not a signal.

The I/O ports 40 may be interfaces that may couple to other peripheral components such as input devices (e.g., keyboard, mouse), sensors, input/output (I/O) modules, and the like. The display 42 may operate as a human machine interface (HMI) to depict visualizations associated with software or executable code being processed by the processor 34. In one embodiment, the display 42 may be a touch display capable of receiving inputs from a user of the augmented reality system 12. The display 42 may be any suitable type of display, such as a liquid crystal display (LCD), plasma display, or an organic light emitting diode (OLED) display, for example. Additionally, in one embodiment, the display 42 may be provided in conjunction with a touch-sensitive mechanism (e.g., a touch screen) that may function as part of a control interface for the augmented reality system 12. The display 42 may depict image data that corresponds to the augmented video data 18 described above.

It should be noted that the components described above with regard to the augmented reality system 12 are exemplary components and the augmented reality system 12 may include additional or fewer components relative to those shown.

Figure 3:
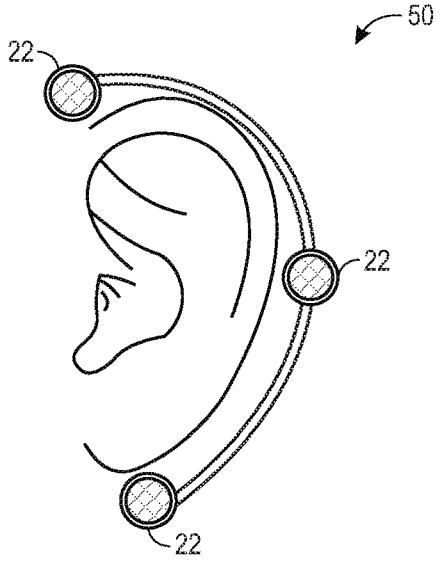
FIG. 3 illustrates a schematic diagram of an augmented reality headset that may be employed with the augmented reality system of FIG. 2, in accordance with embodiments described herein.

With the foregoing in mind, FIG. 3 illustrates an augmented reality headset 50 that may include the multiple augmented reality speakers 22 that surround an ear of the user when the augmented reality headset 50 is worn by the user. As shown in FIG. 3, the augmented reality headset 50 may include three augmented reality speakers 22 positioned at different locations around the user's ear. Each augmented reality speaker 22 may be used to simulate a sound that appears to originate from a particular location based on the provided augmented audio data 20. By way of example, the pitch (e.g., frequency), volume (e.g., amplitude), tone, and other sound properties may be adjusted to enable the augmented reality speakers 22 to provide an audio output that conveys directional information.

As shown in FIG. 3, the augmented reality headset 50 may include at least three speakers 22 affixed to a single ear hook channel. The ear hook channel may include a hollow space or opening to house one or more wires therein. The wires may electrically couple to each of the speakers 22. In one embodiment, the augmented reality headset 50 may include a communication component that may receive wireless or wired signals from the augmented reality system 12, such that the signals may be transmitted to each speaker 22 via a respective wire. The signals may specify the audio output via each speaker 22.

In one embodiment, a first speaker 22 may be positioned above an axis of an ear canal, a second speaker 22 may be parallel to the axis of the ear canal, and a third speaker 22 may be positioned under or behind the ear lobe, as depicted in FIG. 3. The position of each of the speakers 22 may enable the augmented reality system 12 to generate audio output to convey directional information along three separate planes. In some embodiments, the arrangement of the speakers 22 may be adjusted along the ear hook channel to accommodate each individual user's preferential placement. To provide accurate directional information, each speaker 22 may include a location or position sensor relative to the ear hook channel. The location or position sensor may provide the augmented reality system 12 with information as to the relative position of each speaker 22 with respect to the user's ear, such that the augmented reality system 12 may generate the appropriate audio output to convey the directional information.

Figure 4:
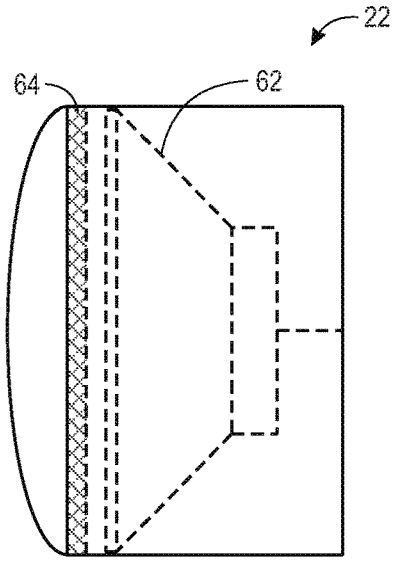
FIG. 4 illustrates a schematic diagram of speakers that may be employed with the augmented reality headset of FIG. 3, in accordance with embodiments described herein.

FIG. 4 illustrates components that may be part of each augmented reality speaker 22. As shown in FIG. 4, the augmented reality speaker 22 may include a speaker 62 and a filter 64. The speaker 62 may be any suitable audio output device. In one embodiment, the speaker 62 may be a piezoelectric speaker that uses the piezoelectric effect for generating sound. That is, the speaker 62 may apply a voltage to a piezoelectric material (e.g., crystalline structure, quartz) to cause the material to oscillate at a certain frequency and produce sounds.

With this in mind, the filter 64 may constrain or direct the sound waves produced by the speaker 62 to emit from the speaker 62 as a beam of sound waves. The beam of sound waves output via the filter 64 may be directed to the user's ear in a particular direction to create a dimensional sound in the same direction. In certain embodiments, the filter 64 may be composed of a metamaterial, which may be made of multiple elements such as metals and plastics. The metamaterial may arrange the elements in a particular pattern at a scale that may be smaller than the wavelengths of the sound waves produced by the speaker 62. The shape, geometry, size, orientation, arrangement, and other physical properties may manipulate or adjust the sound waves produced from the speaker 62 to direct the sound waves to a particular location, within a certain bandwidth, or the like.

Keeping the foregoing in mind and referring back to FIG. 3, each of the three augmented reality speakers 22 may establish three different planes of sound reference for the user. That is, each augmented reality speaker 22 may produce a beam of sound waves that may cause the user to interpret the produced sound as emanating from a particular direction that corresponds to a particular plane. By coordinating the output of sounds produced by the augmented reality speakers 22, the augmented reality system 12 may convey audible information with relative location information.

The augmented reality speaker 22 may include an armature, such that the armature has a coil wrapped around it. An electric current may be passed through the coil, which may be suspended between two magnets. The changes in the current may cause attraction between the coil and magnets to change, and vibrations in the magnetic field may move the armature, thereby producing sound. In some embodiments, the armature may be encased or surrounded by the metamaterial mentioned above. By encasing the armature of the augmented reality speaker 22 with the metamaterial, sound waves that contact the metamaterial may flatten and circumvent the augmented reality speaker 22. In this way, sound waves produced from the environment may still reach the ear of the user receiving the sound waves after being obstructed by the position of the augmented reality speaker 22. Indeed, the flattened sound waves cause the user to perceive that the augmented reality speaker 22 is not physically present with respect to sound waves being propagated around it.

Figure 5:
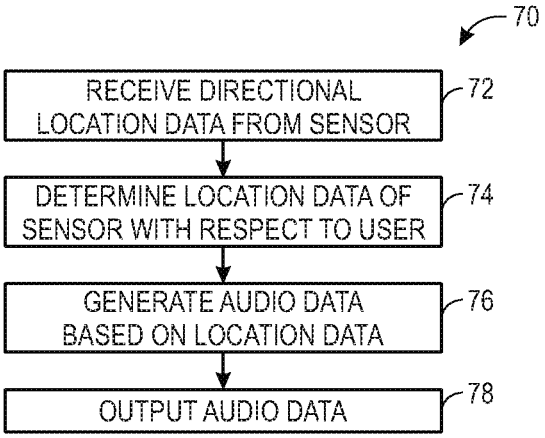
FIG. 5 illustrates a flow chart of an example method for outputting audio data for directional purposes, in accordance with embodiments described herein.

FIG. 5 illustrates an example method 70 that the augmented reality system 12 may employ to convey audible information to a user via augmented audio. Although the following description of the method 70 is described as being performed by the augmented reality system 12, it should be understood that any suitable processor-based system may perform the method 70. In addition, although the following description of the method 70 is described in a particular order, it should be noted that the method 70 may be performed in any suitable order in other embodiments.

Referring now to FIG. 5, at block 72, the augmented reality system 12 may receive directional location data from one or more sensors 14. In one embodiment, the sensors 14 may provide location information (e.g., indoor global positioning system coordinate, location with respect to an object) to the augmented reality system 12. The location information may include data that indicates a particular location of the sensor 14. Alternatively, the sensors 14 may output audible noises that may convey a relative location or direction with respect to the augmented reality system 12. For example, sound may be produced by the augmented reality speakers 22, such that it causes the user of the augmented reality system 12 to perceive that the sound is originating or emanating from a particular direction or location relative to himself That is, if the relative location corresponds to a direction that is to the right of the user wearing the augmented reality headset 50, the augmented reality speakers 22 may output sound waves from the right speakers only. In addition, the sound waves may also convey relative distance information, such as if the relative location of the sensors 14 is close to the user or further away from the user. For example, the amplitude or volume of the sound waves output by the audio reality speakers 22 may increase as the relative distance between the user and the sensors 14 decrease.

By way of example, the sensors 14 may be placed on objects that may be insured or possess a certain amount of value. In this way, the augmented reality system 12 may provide location information related to these objects to a user via the augmented reality headset 50 or the like. Specifically, for example, the augmented reality headset 50 may determine a relative location of the objects based on the data provided by the sensors 14 associated with the objects. The data may be used to determine a relative position of the sensors 14 with respect to the augmented reality headset 50. Based on the relative position of the sensors 14, the augmented reality system 12 may generate a visualization that presents a light (e.g., flashing dot) that corresponds to the location of the sensors 14 with respect to the location of the augmented reality headset 50. Moreover, the augmented reality system 12 may also use the relative location information to produce a sound that appears to originate from the relative location of the sensors 14 with respect to the augmented reality headset 50.

After receiving the data from the sensors 14, the augmented reality system 12 may, at block 74, determine the location of the sensors 14 that produce the directional location data signals with respect to the location of the augmented reality system 12. That is, in some embodiments, the augmented reality system 12 may receive the directional location data and determine a direction in which the signal providing the data originated. In another embodiment, the directional location data may provide the augmented reality system 12 with a frame of reference or object to compare to a present location of the augmented reality system 12. Using the two locations, the augmented reality system 12 may identify a direction in which the sensors 14 may be located with respect to the location of the augmented reality system 12.

At block 76, the augmented reality system 12 may generate directional audio data based on the location data determined at block 74. The directional audio data may be one or more audio signals to be output via the speakers 22 of the augmented audio headset 50, such that the user of the augmented audio headset 50 may interpret the produced audio as originating from a location that corresponds to the sensor 14 that provided the directional audio data. In certain embodiments, the audio output may include ping or ring tones having certain audible properties (e.g., volume, pitch, direction) that cause the user to interpret the audio output as originating from a particular location. In addition, the audio output may include verbal cues or instructions that appear to emanate from the particular location and direct the user of the augmented reality system 12 to the particular location. In one specific example, the audio output may include a chime that increases in volume as the user of the augmented reality system 12 moves closer to the particular location. The chime may change based on the position of the user, such that the user may be aware of a relative position of the particular location with respect to his own position.

As such, at block 78, the augmented reality system 12 may output the audio data via one or more of the speakers 22 of the augmented reality headset 50. In certain embodiments, the audio output may be designed to use one or more of the speakers 22, such that directional information is conveyed to the user. As discussed above, the augmented audio headset 50 may be positioned around a user's ear to enable the user to hear the audio output by the speakers 22, as well as the ambient noise surrounding the user. By conveying the audio output via the augmented reality headset 50, the augmented reality system 12 may provide information to the user while the user maintains his ability to listen to his surroundings. In one specific example, the user may interview a homeowner to ascertain damages incurred to a home for a home insurance claim, while receiving audible indications with regard to locations of certain objects in the home. For example, the sensors 14 may be disposed on electronic devices, jewelry boxes, and other insured objects, and the user may locate each object based on the produced audio output to verify its condition.

Figure 6:
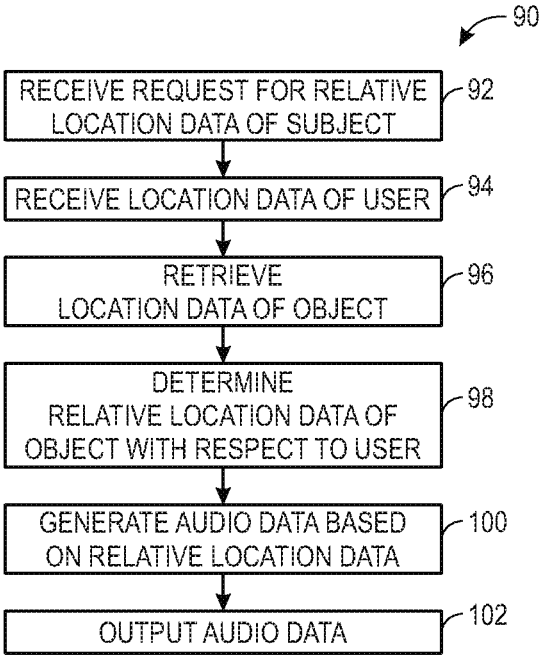
FIG. 6 illustrates a flow chart of an example method for outputting audio data for directional purposes, in accordance with embodiments described herein.

In addition to receiving location information from sensors 14, in some embodiments, the augmented reality system 12 may receive location data via the network 16 from other computing systems. That is, the augmented reality system 12 and the sensors 14 may be communicatively coupled to the network 16, and the location data of the sensors 14 may be retrieved by the augmented reality system 12 via the network 16. Alternatively, location data regarding various objects may be stored on one or more databases communicatively coupled to network 16 and provided to the augmented reality system 12. FIG. 6 illustrates an example method 90 for the augmented reality system 12 to generate audio data based on location data retrieved via the network 16.

Referring now to FIG. 6, at block 92, the augmented reality system 12 may receive a request for relative location data of an object. The request may include an indication of the object. In some embodiments, location information of various objects may be stored on a database or a computing system accessible via the network 16. Alternatively, the sensors 14 disposed on various objects may transmit location data of the respective sensors 14 to the databases or computing systems accessible via the network 16.

After receiving the request for relative location data of the object, at block 94, the augmented reality system 12 may determine location data for the user of the augmented reality system 12. As such, in some embodiments, the augmented reality system 12 may access sensors (e.g., global positioning sensors, Wi-Fi location) disposed on the augmented reality headset 50 to determine a location of the user. Alternatively, the user may input his location via inputs of the augmented reality system 12. In addition, in some embodiments, the user may be holding or wearing a computing system that functions as the augmented reality system 12. In this case, the augmented reality system 12 may use sensors disposed within the same housing to determine its own location, which may be used as the location of the user.

At block 96, the augmented reality system 12 may retrieve the location data of the object referred to in block 92. In one embodiment, the augmented reality system 12 may query a database coupled to the network 16 for the location data. After identifying the location data of the respective object, the augmented reality system 12 may retrieve the location data via the network 16.

At block 98, the augmented reality system 12 may determine a relative location of the object with respect to the location of the user based on the location of the object and the location of the user, as determined in blocks 92 and 94, respectively. At block 100, the augmented reality system 12 may generate audio data based on the relative location data. In certain embodiments, the audio data may include sound waves to output via one or more speakers 22 of the augmented reality headset 50. The sound waves output via the one or more speakers 22 may produce an audible sound that appears to originate from a particular direction or location.

After the augmented reality system 12 generates the audio data, at block 102, the augmented reality system 12 may output the audio data via the speakers 22. To convey the directional information, the audio output may direct sound waves to certain locations of the user's ears to create the illusion of sound being generated from a location that corresponds to the requested object.

The technical effects of the systems and methods described herein include using data acquired from various sensors to determine location information for generating audio data to convey the location information for a user. By providing the ability to provide location information in an augmented audio format, users may receive audible information concerning a location of an object while simultaneously listening to his surrounding environment.

While only certain features of disclosed embodiments have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A system, comprising:

a plurality of speakers, wherein each speaker of the plurality of speakers is configured to output one or more sound waves, and wherein each speaker of the plurality of speakers comprises an armature encased in a metamaterial configured to flatten the one or more sound waves; and a processor configured to:

receive location information regarding an object;

generate audio data based on the location information and directional information related to a relative position of the system with respect to the location information; and initiate the output of the one or more sound waves via at least one of the plurality of speakers based on the audio data.

2. The system of claim 1, comprising one or more sensors associated with the object, wherein the one or more sensors is configured to transmit the location information to the processor.

3. The system of claim 1, wherein the at least one of the plurality of speakers comprises a piezoelectric speaker.

4. The system of claim 1, wherein the at least one of the plurality of speakers comprises a filter comprising additional metamaterial.

5. The system of claim 4, wherein the filter is configured to direct the one or more sound waves such that origination is conveyed from a particular direction.

6. An audio speaker system, comprising:

a plurality of speakers configured to output one or more sound waves, wherein each speaker of the plurality of speakers comprises:

an armature encased in a metamaterial configured to flatten one or more sound waves output by a respective speaker; and a filter comprising additional metamaterial; and a channel configured to connect each speaker of the plurality of speakers to each other, wherein the channel is configured to be disposed on an ear of a user.

7. The audio speaker system of claim 6, wherein the metamaterial is configured to adjust the one or more sound waves to direct the one or more soundwaves towards a direction.

8. The audio speaker system of claim 6, comprising a processor configured to:

receive location information regarding an object; and generate the one or more sound waves based on the location information.

9. The audio speaker system of claim 8, wherein the processor is configured to generate the one or more sound waves to include directional characteristics with respect to the location information.

10. The audio speaker system of claim 6, comprising a processor configured to:

receive an indication of a request to locate an object;

retrieve location information associated with the object; and generate the one or more sound waves based on a relationship between the location information and a location of the audio speaker system.

11. The audio speaker system of claim 10, wherein the location information is retrieved via a database.

12. The audio speaker system of claim 10, wherein the location information is retrieved via a sensor disposed on the object.

13. A method, comprising:

receiving, via a processor, location information regarding an object;

generating, via the processor, audio data based on the location information, wherein the audio data is configured to convey directional information related to a relative position of the processor with respect to the location information; and sending, via the processor, the audio data to at least one of a plurality of speakers, wherein the plurality of speakers is configured to output one or more sound waves based on the audio data, and wherein a respective speaker of the plurality of speakers comprises a respective armature encased in a metamaterial configured to flatten one or more sound waves output by the respective speaker.

14. The method of claim 13, comprising:

receiving an indication of the object; and retrieving the location information from one or more sensors disposed on the object.

15. The method of claim 13, comprising:

receiving an indication of the object; and retrieving the location information from a database comprising a plurality of location datasets associated with a plurality of objects.

16. The method of claim 13, wherein the at least one of the plurality of speakers comprises a piezoelectric speaker.

17. The method of claim 13, wherein the at least one of the plurality of speakers comprises a filter comprising additional metamaterial.

18. The system of claim 1, wherein the metamaterial comprises a plurality of elements arranged in a pattern at a scale that is smaller than the one or more sound waves output by the at least one of the plurality of speakers.

19. The audio speaker system of claim 6, wherein the metamaterial comprises a plurality of elements arranged in a pattern at a scale that is smaller than the one or more sound waves output by the respective speaker.

20. The method of claim 13, wherein the metamaterial comprises a plurality of elements arranged in a pattern at a scale that is smaller than the one or more sound waves output by the respective speaker.

* * * * *